US005505384A

United States Patent [19]

Camplin

[11] Patent Number: 5,505,384

[45] Date of Patent: Apr. 9, 1996

[54] RATE SHAPING CONTROL VALVE FOR FUEL INJECTION NOZZLE

[75] Inventor: Frederick A. Camplin, Peoria, Ill.

[73] Assignee: Caterpillar Inc., Peoria, Ill.

[21] Appl. No.: 267,327

[22] Filed: Jun. 28, 1994

[51] Int. Cl.[6] ..... F02M 47/00

[52] U.S. Cl. ..... 239/533.5; 239/92

[58] Field of Search ..... 239/88, 92, 533.3–533.5, 239/533.9, 533.7

[56] References Cited

U.S. PATENT DOCUMENTS

| | | | |
|---|---|---|---|
| 2,560,799 | 7/1951 | Johnson . | |
| 3,342,422 | 9/1967 | Millington et al. | 239/533.5 |
| 3,391,871 | 7/1968 | Fleischer et al. | 239/533.4 |
| 3,456,884 | 7/1969 | Knight et al. | 239/533.5 |
| 4,081,140 | 3/1978 | Kranc . | |
| 4,527,738 | 7/1985 | Martin . | |
| 4,958,771 | 9/1990 | Klomp . | |
| 5,020,500 | 6/1991 | Kelly . | |
| 5,287,838 | 2/1994 | Wells . | |

FOREIGN PATENT DOCUMENTS

| | | |
|---|---|---|
| 3841322 | 9/1992 | Germany . |

*Primary Examiner*—Karen B. Merritt

*Attorney, Agent, or Firm*—Dykema Gossett; Kevin M. Hinman

[57] ABSTRACT

A fuel injector nozzle assembly has a housing defining a blind bore and at least one injection orifice at the bottom portion thereof and a fuel injection passage fluidly connecting the bottom portion of the blind bore and a source of pressurized fluid. A primary check is disposed in the blind bore. A spring between the housing and the check establishes a first valve opening pressure. A secondary check is slidably disposed in the fuel injection passage, defining an aperture therethrough. A secondary check spring is disposed between the secondary check and the housing, establishing a second valve opening pressure.

3 Claims, 4 Drawing Sheets

RATE SHAPING CONTROL VALVE FOR FUEL INJECTION NOZZLE

TECHNICAL FIELD

The present invention relates generally to fuel injectors and, more particularly to fuel injector nozzles.

BACKGROUND ART

Examples of a high pressure fuel injection system are shown in U.S. Pat. No. 4,081,140 issued to Kranc on Mar. 28, 1978, U.S. Pat. No. 5,020,500 issued to Kelly on Jun. 4, 1991, and U.S. Pat. No. 5,191,867 issued to Glassey et al. on Mar. 9, 1993. Engines equipped with high pressure fuel injection systems have an optimal volumetric injection rate. For diesel-cycle engines, this optimal injection rate has a gradual rise, a period of stabilization, followed by a sharp drop. Means of producing this characteristic profile are commonly referred to as rate shaping means or devices because they are used to shape the volumetric rate of fuel injection into an engine combustion chamber. The gradual rise followed by a sharp drop in fuel injection has the specific benefit of minimizing particulate emissions from combustion. It also minimizes combustion noise.

Fuel injector nozzles typically include a housing or tip with an elongated cavity or void along a first axis. At least one injection orifice fluidly connects one end portion of the cavity with an atmosphere (e.g., engine combustion chamber) external to the fuel injector. A needle check is slidably disposed within the cavity for translation between a first position in which a first end portion of the needle check seats against a seat of the tip, wherein the first end portion of the check is seated against the seat, covering or blocking the injection orifice(s), and a second position wherein the first end portion of the check is spaced from the seat and does not block the injection orifice.

In the fuel injector of Glassey et al., a spring is disposed between the needle check and the housing, tending to bias the needle toward the first position. Pressurized fuel directed to a portion of the cavity in which the first end portion of the check is disposed overcomes the spring to move the check away from the seat to the second position. Fuel is transferred from a fuel pumping chamber in which the fuel is pressurized, directly to that portion of the cavity, a fuel injection chamber, in which the first end portion of the check is disposed without the benefit of rate shaping.

The fuel injector nozzle disclosed by Kranc has a valve disposed between a fuel pumping chamber, and a first end portion of the cavity in which the needle check is disposed. However, the valve of Kranc provides essentially an on-off control of flow to the injection chamber. This does not provide the gradual rise in flow rate desired for fuel entry into the injection chamber at the beginning of the injection cycle.

Kelly discloses a fuel injector in which flow is varied as a function of lift height of the check from the seat, with flow restricted from the first position to a predetermined midpoint to provide the desired gradual rise in flow. The flow is relatively unrestricted from the midpoint to the second position. However, Kelly does not teach the use of a second valve or check to control fluid flow to the needle check.

It is desired to provide a fuel injector nozzle having a valve disposed between the pumping chamber and the fuel injection chamber which restricts the transfer of fuel to the first end portion of the check within injection chamber to a relatively low initial rate followed by a higher rate of flow with displacement of this valve.

DISCLOSURE OF THE INVENTION

In one aspect of the present invention, a fuel injector nozzle assembly has a primary check valve, or needle check, disposed in a path between a fuel pumping chamber and at least one fuel spray orifice. The nozzle also has a secondary check valve disposed between the pumping chamber and the primary check valve. The secondary check valve defines a restrictive orifice for transferring fuel from the pumping chamber to the injection chamber, in which the primary check is located, at a reduced rate of flow. A high rate of fuel flow from the pumping chamber to the injection chamber is achieved when a predetermined pressure level is reached. This provides a dual rate of injection into the injection chamber and through the orifice.

In one particular aspect of the present invention, the secondary check includes a check capsule. A check capsule spring is functionally disposed between the capsule and the housing and establishes a capsule opening pressure. A secondary check is disposed within a void in the capsule.

In yet another aspect of the present invention, the secondary check defines an aperture therethrough transferring fuel at relatively low pressure. The valve opens at higher pressure to transfer fuel at a relatively high flow rate past a fluted end portion of the secondary check with the flutes providing a relatively large increase in flow area with a relatively small amount of axial displacement.

BEST MODE FOR CARRYING OUT THE INVENTION

Figure 1:
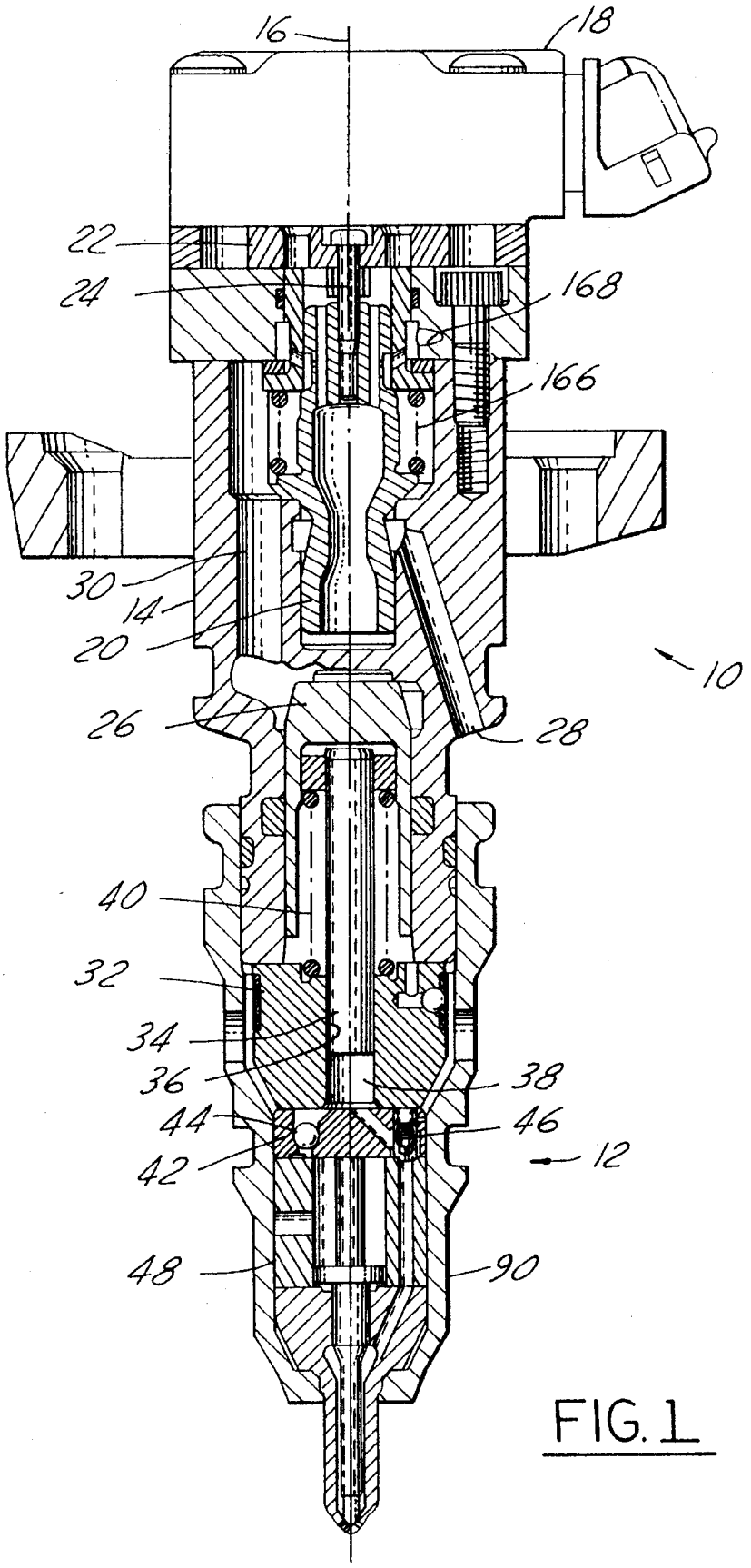
FIG. 1 is a diagrammatic cross-sectional view of one embodiment of a unit fuel injector.

An exemplary fuel injector such as a hydraulically-actuated electronically-controlled unit fuel injector 10, hereinafter referred to as HEUI fuel injector, is shown in FIG. 1. Although shown here as a unitized, or unit fuel injector, the injector 10 could alternatively be of a modular construction, for example, a nozzle assembly 12 separate from but communicating with a fuel pressurization device or source of pressurized fuel.

The fuel injector 10 of FIG. 1, has an injector body 14 with a central longitudinal axis 16. An electrical actuator 18, such as a solenoid, is mounted over an upper end portion of the injector body 14. A poppet valve 20 is slidably disposed in the body 14 for operable movement between first (downward) and second (upward) positions. The poppet valve 20 is fixed to a movable armature 22 of the solenoid actuator 18 by, for example, an intermediate threaded fastener 24. The solenoid actuator 18 operably displaces the poppet valve 20 between the first position and the second position in response to electronic signals of the solenoid 18 by an electronic control module (not shown).

An intensifier piston 25 is slidably disposed in the body 14 for axial displacement therein. A hydraulic fluid inlet passage 28 communicates highly pressurized hydraulic fluid to the poppet valve from a high pressure manifold (not shown). Internal hydraulic fluid passages 30 communicate hydraulic fluid from the poppet valve 20 to the intensifier piston 26 when the poppet valve 20 is at its second (upward) position. When the poppet valve 20 is in the first (downward) position, the poppet valve blocks communication of hydraulic actuating fluid from the inlet passage 28 to the intensifier piston 26.

A lower end portion of the injector body 14 abuts a barrel assembly 32. A reciprocal fuel pump plunger 34 extends from the piston 26 downward into an axial bore 36 of the barrel assembly 32. A fuel pumping chamber 38 is defined by a portion of the barrel bore 36 at one end portion of the plunger 34. A pump spring 40 biases the plunger 34 and the intensifier piston 25 upward according to FIG. 1.

Beneath the barrel assembly 32 is the nozzle assembly 12. A check stop 42 of the nozzle 12 is disposed beneath the barrel assembly 32. A first inlet check valve 44, such as a ball type check valve, in the stop 42 is in fluid communication with the fuel pumping chamber 38. An encapsulated rate shaping control valve 46 in the stop 42 prevents passage of fuel from the pumping chamber 38 until a selected first valve opening pressure (VOP) is reached at which point fuel is allowed to pass through a very restrictive opening. At a second VOP for this valve 46, significantly greater than the first VOP, fuel can flow around the encapsulated rate shaping control valve assembly 46, avoiding the restriction. These features are more clearly seen in FIGS. 2 and 3.

A cylindrical sleeve 48 is disposed beneath the check stop 42. The sleeve 48 defines an axial spring chamber 50 therethrough, a separate discharge or fuel injection passage 52 preferably parallel to the spring chamber 50 and an exhaust port 54 passing from an outside of the sleeve to the spring chamber 50 preferably normal to the central axis 16. The fuel injection passage 52 is in fluid communication with the encapsulated rate shaping control valve 46.

A nozzle spray tip 56 abuts the sleeve 48 opposite the stop 42 on one end. An axially extending blind bore 58 extends from an open end 60 of the bore 58, in the end abutting the sleeve 48, to a bottom or seat 62 of the blind bore 58 in an end portion 64 of the tip 56. One or more fuel injection spray orifices 66 are shown defined through the tip 56 at the end portion 64. The fuel injection passage 52 passes from the sleeve 48 into the nozzle spray tip 56, communicates fluid to a cardioid section 68 of an injection chamber 70 of the blind bore 58. A portion of the blind bore 58 between the cardioid section 68 and the open end 60 of the bore 58 defines a guide passage 72. The spring chamber 50, and the blind bore 58, can be characterized as a single elongated check cavity 74 extending along the axis 16.

A primary check 76, such as a needle check, is slidably disposed in the check cavity 74 for axial translation between a first (closed) position and a second (open) position. The needle check 76 has a guide portion 78 sized to provide a minimum annular clearance with the guide passage 72. A first end portion 80 of the needle check 76 engages the bottom 62 of the blind bore 58 in the closed position, defining an annular surface area of engagement therewith, an axial projection of which is smaller than a cross-sectional area of the guide portion 78. Preferably, the first end portion 80 of the needle check 76 covers the fuel injection spray orifices 66 when the check 76 is disposed in the closed position. A spring seat 82 of the check 76 is larger in diameter than the guide portion 78, extending radially almost the full diameter of the spring chamber 50.

An intermediate portion 84 of the needle check 76 between the guide portion 78 and the first end portion 80 is of a diameter selected smaller than that of the guide portion 78. A travel limit portion 86 of the needle check 76 axially extends from the spring seat 82 opposite the guide portion 78. A helical compression spring 88 is disposed in the spring chamber 50 between the spring seat 82 and the check stop 42. The spring 88 biases the first end portion 80 against the seat 62 of the blind bore 58.

A casing 90 such as an internally-threaded nut encases a lower portion of the injector body 14, the barrel assembly 32, the check stop 42, the sleeve 48, and the tip 56 to maintain them in an operating relationship with respect to one another. Together the stop 42, the sleeve 48, the tip 56, and the casing 90 may be characterized as a nozzle housing 92.

The casing 90 has one or more fuel inlet openings 94 passing therethrough approximately normal to the axis 16. The casing 90 defines an annular fuel passage 96 between itself and the barrel assembly 32 and the stop 42, which is fluidly connected to the fuel inlet openings 94. An edge filter 98 in the stop 42 extends from the annular fuel passage 96 to the first inlet check valve 44.

Figure 3:
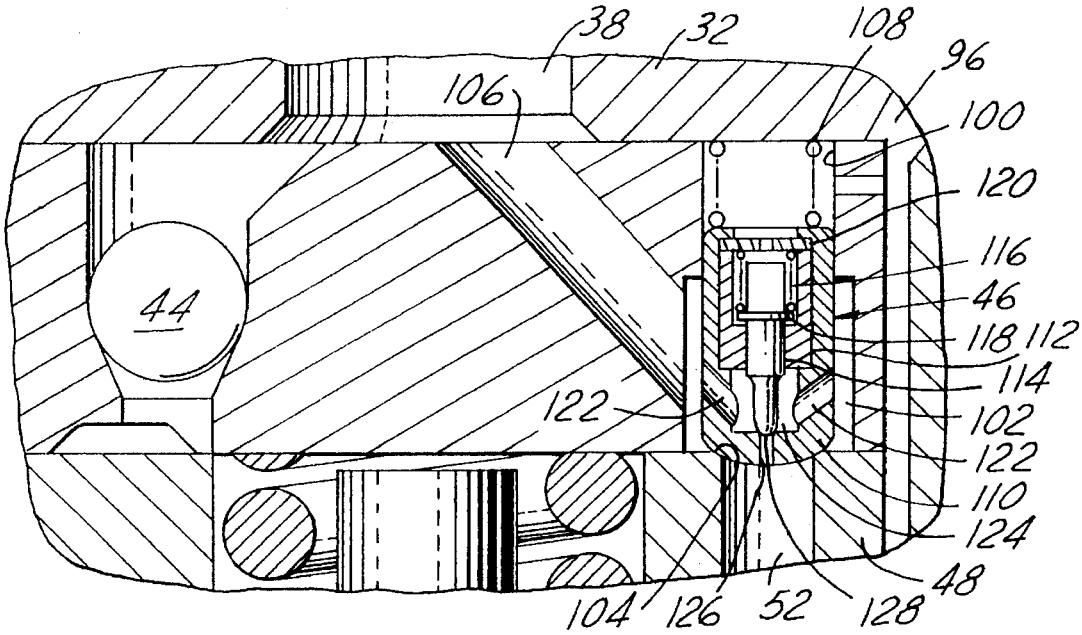
FIG. 3 is a diagrammatic enlarged view of a portion of FIG. 2 including the encapsulated check valve.

The encapsulated rate shaping control valve assembly 46 is slidably disposed in a capsule guide passage 100 in the stop 42 adjacent the barrel assembly 32. A pressure chamber 102 is axially aligned with the capsule guide passage 100 in the stop 42 and opens toward the fuel injection passage 52 of the sleeve 48. A seat 104 for the encapsulated rate shaping control valve 46 is provided along the fuel injection passage 52. The pressure chamber 102 is connected with the fuel pumping chamber 38 by a fuel injection passage stop portion 106. A capsule spring 108 is disposed between the barrel assembly 32 and the encapsulated rate shaping control valve assembly 46, biasing the valve assembly 46 toward the seat 104. The encapsulated rate shaping control valve 46 as shown in FIG. 3 includes a capsule 110 and valve guide 112 in which a pilot check valve 114 is slidably disposed. A pilot spring 116 is disposed between a spring seat 118 of the pilot check valve 114 and a cap 120 closing an open end of the valve guide 112. The capsule 110 has ports 122 open from the pressure chamber 102 to a pilot chamber 124 within the capsule 110. A pilot orifice 126 passes from the pilot chamber 124 to a bottom of the capsule 110 where it opens to the fuel injection passage 52. An end portion 128 of the pilot check valve 114 is biased against the pilot orifice 126 by the pilot spring 116. The capsule spring 108 and pilot spring 116 are selected so that as pressure within the pressure chamber 102 and the pilot chamber 124 increases, the pilot check valve 114 is displaced upward at relatively low pressure to open the pilot orifice 126 permitting fuel flow therepast before the fuel pressure displaces the entire encapsulated rate shaping control valve 46 upward and away from the seat 104 for the encapsulated rate shaping control valve 46. The pilot spring 116, however, must be able to resist displacement of the pilot check valve 114 from the pilot orifice 126 by pressure from combustion gases which have leaked past the first end portion 80 of the check 76 from a combustion chamber.

Figure 4:
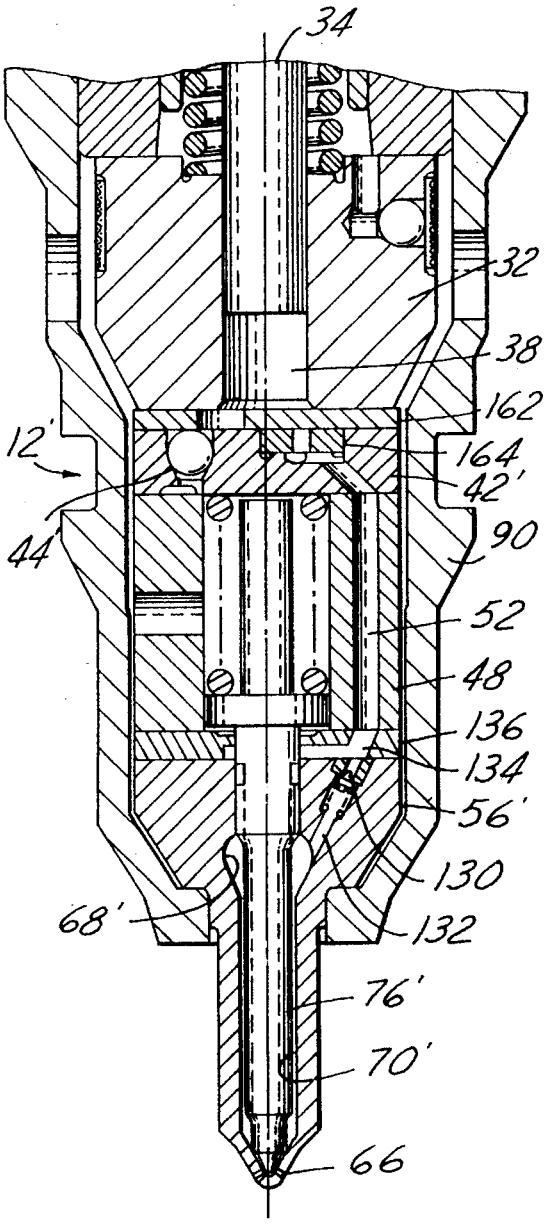
FIG. 4 is a diagrammatic enlarged cross-sectional view of a second embodiment of a nozzle area of the unit fuel injector of FIG. 1.
Figure 5:
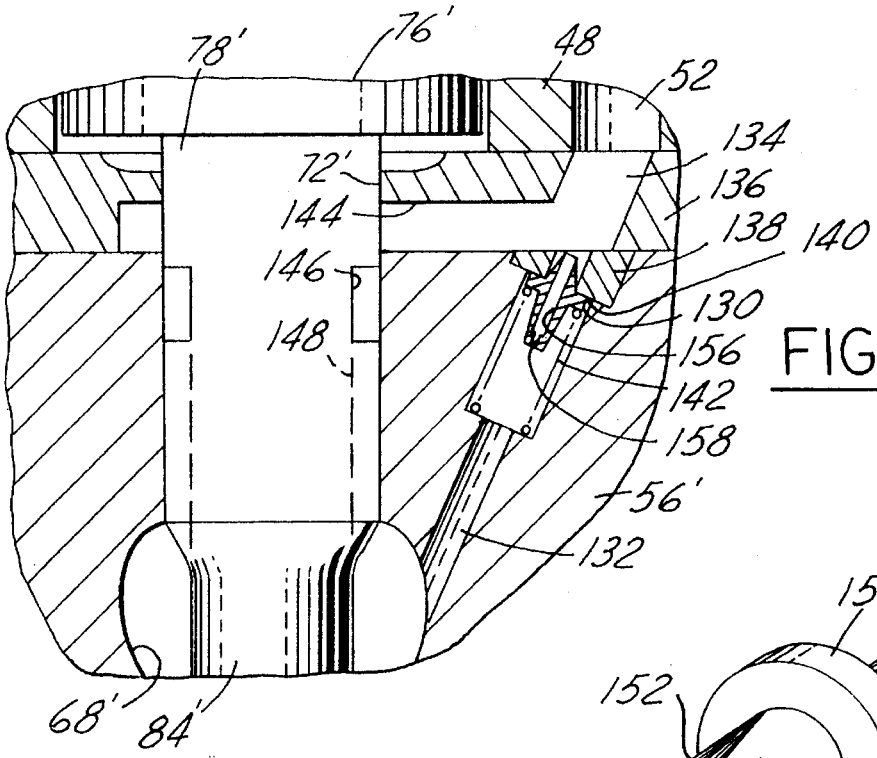
FIG. 5 is a diagrammatic enlarged view of a portion of FIG. 4 including the fluted check valve.
Figure 6:
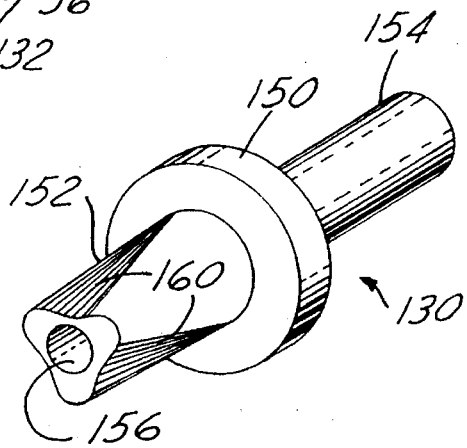
FIG. 6 is a exemplary perspective view of a secondary check of the nozzle of FIG. 5.

In an alternative embodiment shown in FIGS. 4–6, a secondary check 130, such as a fluted check, is disposed in a modified fuel injection passage 132 in a nozzle spray tip 56'. The modified passage 132 extends from a cardioid chamber 68' to a fuel injection passage 134 of an intermediate plate 136. The intermediate plate 136 is disposed between the nozzle spray tip 56' and the sleeve 48. As best seen in FIG. 5, the fluted check 130 is retained in the tip by a wedge shaped cap 138. The check 130 is biased against a shoulder 140 of the cap 138 by a valve spring 142 disposed between the tip 56' and the check 130. The wedge shaped cap 138 is disposed over the modified fuel injection passage 132 and has an aperture therethrough for communicating fluid from the fuel injection passage 134 of the intermediate plate 136.

The intermediate plate 136 has a lateral groove 144 in a side directed toward the tip 56 which serves as a lateral extension of the fuel injection passage 134. The lateral groove 144 extends to the guide passage 72. The check 76' is shown with a pair of notches 146 in the guide portion 78', disposed just below the groove 144 when the check 76' is in the first position. A pair of axial grooves 148 (FIG. 5) in the check extend from the notches 146 downward to an intermediate portion 84' of the check. When the check 76' is in the second position, the notches 146 are open to the groove 144, fluidly connecting the lateral groove 144 with the cardioid section 68'.

The fluted check 130, best shown in FIG. 6, has a spring seat portion 150, an input portion 152 extending from the spring seat portion 150 toward the fuel injection passage 134, and an output portion 154 extending from the spring seat portion 150 opposite the input portion 152 and toward the cardioid chamber 68'. The output portion 154 preferably has a slight taper, and helps maintain the valve spring 142 in a generally concentric relationship with the check 130. The input portion 152 similarly maintains the check 130 in a generally concentric relationship with the opening in the cap 138. A central orifice 156 passes through the length of the fluted check 130. The orifice 156 is of an approximately constant diameter except for near an end of the output portion 154 where it necks down to a smaller diameter pilot portion 158. The output portion preferably has a moderate taper, decreasing in diameter with increased distance from the spring seat 150. The input portion 152 has a plurality of, for example, three tapered flutes 160 which extend from a maximum depth and width at an end of the input portion distal to the spring seat 150 to a depth and width of effectively zero at the spring seat portion 150. The valve spring 142 is selected to unseat at approximately the same pressure at which the encapsulated rate shaping control valve is unseated from the seat 104. Optionally, the check 76' may be provided without the notches 146 and grooves 148.

Figure 2:
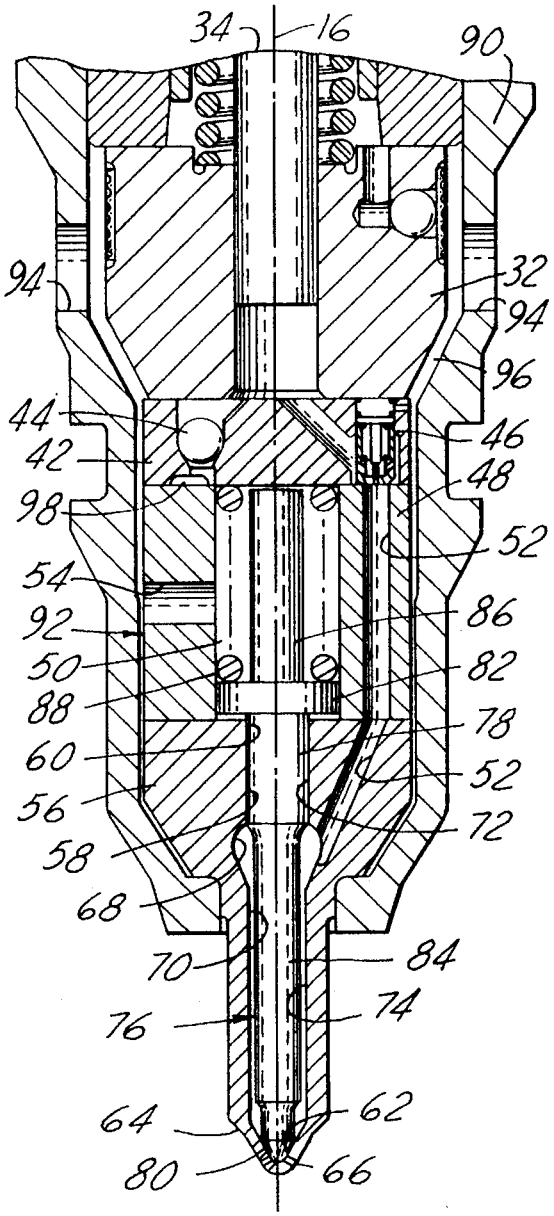
FIG. 2 is a diagrammatic enlarged cross-sectional view of a nozzle area of the unit fuel injector of FIG. 1.

This alternative embodiment, as shown in FIGS. 4–6, also varies from the embodiment of FIGS. 1–3 in the area of the stop 42'. Disposed between the barrel assembly 32 and the stop 42' of this alternative embodiment, is disposed an intermediate spacer plate 162. The intermediate spacer plate 162 defines an aperture therethrough fluidly connecting the fuel pumping chamber 38 with the first check valve 44'. A second or reverse flow check valve 164 in the stop 42' permits fluid flow therepast from the pumping chamber 38, but blocks the return of fluid or combustion gas to the pumping chamber 38. The reverse flow check valve 164 is preferably constructed as disclosed in U.S. Pat. No. 5,287,838 issued to Wells on Feb. 22, 1994.

Industrial Applicability

In operation, actuating fluid enters the fluid inlet passage 28 at a selected pressure, for example 23 MPa (3335 psi). In the first (downward) position, the poppet valve 20 blocks the further advance of the pressurized fluid into the injector body 14. The poppet valve 20 also keeps the internal hydraulic fluid passages 30 filled with hydraulic fluid at relatively lower fluid pressure when in the first position.

An electronic signal from an electronic control module (not shown) causes the solenoid actuator 18 to be electronically energized, thereby displacing the armature 22 upward and moving the poppet valve 20 to the second (upward) position. When the poppet valve 20 moves to the second position, the pressure of the fluid in the internal hydraulic fluid passages 30 rapidly increases due to communication with the inlet passage 28. The pressure of the hydraulic actuating fluid acts against the intensifier piston 26, forcing it and the plunger 34 downward against the spring 40.

A lower pressure fuel transfer pump (not shown) supplies fuel to the inlet opening 94 through a fuel rail or manifold preferably defined in a cylinder head (not shown) of an engine (not shown). Low pressure fuel enters the annular fuel passage 96 through the inlet openings 94, surrounding the barrel assembly 32 and the stop 42. Fuel passes from the annular passage 96, through the edge filter passage 98, past the first check valve 44, and into the fuel pumping chamber 38.

In the embodiment of FIGS. 1–3, low pressure fuel passes from the pumping chamber 38, to the pressure chamber 102 where it is blocked by the encapsulated rate shaping control valve assembly 46. Low pressure fuel enters the ports 122 in the capsule 110. The low pressure of the fuel exceeds a selected pilot valve opening pressure (VOP) established by the spring 116, lifting the pilot check valve 114 upward to open the pilot orifice 126. An area ratio between that portion of check valve 114 slidably disposed in the valve guide 112 and the area of the orifice 126 is calculated to allow pilot check valve 114 displacement at low fuel pressures while resisting displacement by combustion gases leaking past the needle check 76. The fuel enters and fills the fuel injection passage 52 and the injection chamber 70 of the blind bore 58.

The hydraulic actuating fluid acting against the intensifier piston 26 generates a force acting on the fuel within the pumping chamber 38. That force is equal to the force on the intensifier piston 26 less that of the spring 40. As the spring is of relatively low load characteristics, the force against the fuel in the pumping chamber will nearly equal the force against the intensifier piston 26. The fuel in the fuel pumping chamber 38 is therefore pressurized to a level approximately equal to the pressure of the hydraulic actuating fluid times the effective cross-sectional area of the intensifier piston 26 divided by the effective cross-sectional area of the plunger 34. An exemplary ratio of areas is approximately 7, resulting in a fuel pressure of approximately 161 MPa (23350 psi) when the selected hydraulic pressure is about 23 MPa (3335 psi). The highly pressurized fuel within the pumping chamber 38, is in fluid communication with the fuel in the fuel injection passages 52, causing fuel in the injection chamber 70 to be pressurized very rapidly. Rapidly pressurizing fuel in the injection chamber 70 acts against the needle check 76 on an area equal to a cross-section of the guide portion 78 minus a seating area defined by the engagement between the first end portion 80 of the check 76 and the seat 62 of the bore 58. At a first valve opening pressure (VOP), the resultant force against the check 76 lifts it upward, overcoming the spring 88. When the check 76 lifts away from the seat 62 in the bore 58, the fuel begins to pass through the injection orifices 66 and into the combustion chamber (not shown). Fuel discharge begins when the first VOP is reached. Optimally for the fuel injection illustrated, the fuel injector 10 has a relatively low first VOP needed to unseat the check 76, followed by a gradually rising rate of volumetric flow through the injection orifices 66 and followed by a sharp drop in volumetric flow rate to the end of injection.

Figure 7:
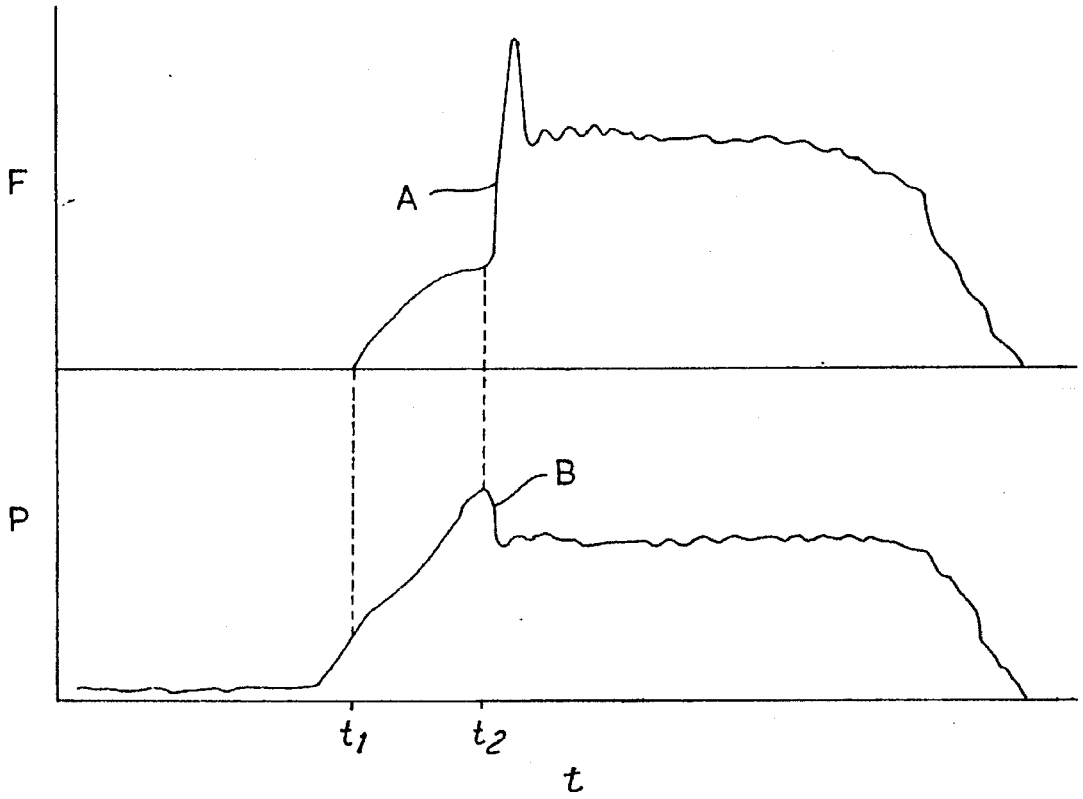
FIG. 7 is a plot of volumetric flow rate, F, from the injector as a function of time, t, and a plot of fuel pressure, P, as a function of time, t, for an injection cycle of one embodiment of the present invention.

The encapsulated rate shaping control valve assembly 46 aids in providing an optimal rate of fuel discharge in the following manner. Fuel is forced from the pumping chamber 38 by the plunger 34. The fuel initially passes through the passage 106 to the pressure chamber 102 and through the restrictive pilot orifice 126 in the capsule 110, past the pilot check valve 114, already displaced upward by the pressure of the fuel. The capsule spring 108 initially maintains the capsule 110 against the seat 104, forcing fuel through the orifice 126. Pressurized fuel in the pressure chamber 102 acts against a bottom portion of the valve assembly 46 not disposed within the seat 104 to overcome the spring 108 and unseat the valve assembly 46 when the second VOP of the valve assembly 46 is reached. When the valve assembly 46 is unseated from the seat 104, the rate of fluid flow past the valve assembly 46 suddenly increases. This is illustrated in FIG. 7 showing an exemplary plot A of flow F as a function of time and plot B of pressure P as a function of time t of an analytical model representative of one embodiment of the present disclosure. When P reaches a peak, the second VOP of the valve assembly 46 at time t2, the flow rate makes a very rapid increase. The pilot orifice 126 thus restricts flow between times t2 and t1 to provide the desired gradually rising rate of volumetric flow through the injection orifice(s) during the initial stage of injection. Time $t_1$ represents the VOP of needle check 76.

To end fuel injection, the electronic signal from the electronic control module is discontinued causing the solenoid actuator 18 to be electrically deenergized. A return spring 166 then moves the poppet valve 20 and armature 22 to the first position thereby blocking the inlet passage 28 and opening fluid communication between the passages 30 and a drain passage 168. When the fuel pressure in passages 30 drops sufficiently, the pump spring 40 axially displaces the plunger 34 and the piston 26 upwardly according to FIG. 1, thereby increasing the volume of the fuel pumping chamber 38. When the high pressure of fuel in the pumping chamber 38 has been sufficiently lowered, and the fuel pressure within the injection chamber 70 sufficiently drops, the spring 83 acts to quickly return the check 76 to the first position, providing the desired rapid termination of volumetric flow through the injection orifices 66.

The alternative embodiment shown in FIGS. 4–6 is able to provide essentially the same flow rate and pressure valves as a function of time when a plain needle check 76 without the notches 146 and grooves 148 is employed. Functionally, the fluted check 130 can be analogized to the capsule 110 of the first embodiment. Both provide restrictive orifices through which fuel must pass until there is sufficient pressure to overcome a spring load against the capsule 110 or fluted check 130. However, because the fluted check 130 does not have an equivalent to the pilot check valve 114, an alternative provision must be made for preventing hot combustion gases from reaching the fuel pumping chamber 38. That is accomplished in the present invention by the second check valve 164 in the stop 42'.

The second check valve 164 permits the flow of low pressure fuel from the pumping chamber 38 to pass into the fuel injection passage 52, down to the fuel injection passage of the intermediate plate 134, and to the fluted check 130. Fuel fills the groove 144. The low pressure fuel passes through the central orifice 156 of the fluted check 130 to refill the injection chamber 70' and the injection passage 52 as required. Once the selected first needle check VOP has been reached at time t1, flow to the orifice(s) 66 is restricted by the pilot portion 158 of the central orifice 160. At time t2, the pressure against the fluted check 130 overcomes the spring 142 to force the fluted check to open. Fuel then moves up the flutes, around the sleeve and down through the modified fuel injection passages 132 to the injection chamber 70' and through the orifice 166 at a greatly increased volumetric rate of flow.

When a check valve 76' having notches 146 and axial grooves 148 is employed with the fluted check 130, the fluid flow rate and pressure traces F and P are expected to vary from those shown in FIG. 7. If the needle check 76' will reach a height at which the notches 146 are in fluid communication with the groove 144, before the fluted check 130 opens, the check 130 will remain closed. The springs 140 and 88 and the restrictive orifice portion 158 can also be sized so that the fluted check 130 opens before the notches 146 are open to the groove 144.

It should be appreciated that although this invention is described in the context of a HEUI unit fuel injector, it is equally applicable to nonunitized HEUI fuel injectors as well as mechanically actuated fuel injectors. This invention is well suited for use with any high pressure fuel injector employing a needle check 76.

Other aspects, objects and advantages of this invention can be obtained from a study of the drawings, the disclosure and the appended claims.

I claim:

1. A fuel injector nozzle assembly comprising:

a housing defining a blind bore and at least one injection orifice at a bottom portion of the blind bore and also defining a fuel injection passage therein providing fluid communication between the bottom portion of the blind bore and a source of pressurized fuel;

a primary check slidably disposed in the blind bore, said primary check movable between first and second positions wherein said primary check in the first position blocks the at least one injection orifice;

a primary check spring disposed between the primary check and the housing biasing the primary check toward the first position wherein pressurized fuel at a first valve opening pressure causes the primary check to lift from the bottom portion to permit the fuel to flow through the at least one injection orifice;

a secondary check slidably disposed in the fuel injection passage against a seat therein on a source side thereof in a first position and defining a pilot orifice therethrough restricting fuel flow from the source of pressurized fuel to the primary check in the first position;

a secondary check spring functionally disposed between the secondary check and the housing biasing the secondary check toward the first position wherein pressurized fuel from the source of pressurized fuel at a second valve opening pressure greater than the first valve opening pressure lifts the secondary check from the seat to permit substantially unrestricted fuel flow from the source of pressurized fuel to the primary check; and a back flow restriction in the fuel injection passage (inhibits) inhibiting flow therethrough from the primary check to the source of pressurized fuel.

2. The fuel injector nozzle assembly of claim 1, wherein:

the backflow restriction includes a check valve proximate to the source of pressurized fuel.

3. The fuel injector nozzle assembly of claim 1, wherein the backflow restriction includes:

a pilot check slidably disposed within the secondary check on a source side thereof and in a first position blocking the pilot orifice; and a spring disposed between the secondary check and the pilot check biasing the pilot check to the first position wherein pressurized fuel at a pilot valve opening pressure less than the first valve opening pressure lifts the pilot check from a pilot seat to permit restricted fuel flow from the source of pressurized fuel through the pilot orifice to the primary check.

* * * * *

UNITED STATES PATENT AND TRADEMARK OFFICE

CERTIFICATE OF CORRECTION

PATENT NO. : 5,505,384

DATED : April 9, 1996

INVENTOR(S) : Camplin

It is certified that error appears in the above-indentified patent and that said Letters Patent is hereby corrected as shown below:

Column 8, line 61, please delete --(inhibits)--.

Signed and Sealed this

Ninth Day of July, 1996

*Attest:*

*Attesting Officer*

BRUCE LEHMAN

*Commissioner of Patents and Trademarks*